United States Patent [19]

Vigano'

[11] Patent Number: 4,596,161

[45] Date of Patent: Jun. 24, 1986

[54] GRIPPER MEMBER CONTROL DEVICE FOR BOOKBINDING MACHINES

[75] Inventor: Giovanni Vigano', Milan, Italy

[73] Assignee: Plastiver S.a.s. di Giovanni Vigano' & C., Ciserano-Zinogia (BG), Italy

[21] Appl. No.: 582,477

[22] Filed: Feb. 22, 1984

[30] Foreign Application Priority Data

Feb. 25, 1983 [IT] Italy ..... 20935/83[U]

[51] Int. Cl.[4] ..... F16H 21/44; F16H 21/54; F16H 25/18

[52] U.S. Cl. ..... 74/109; 74/422; 198/377

[58] Field of Search ..... 74/109, 422; 198/377, 198/802

[56] References Cited

U.S. PATENT DOCUMENTS 1,389,887 9/1921 Leyland et al. ..... 198/802

3,589,205 6/1971 Radovic ..... 74/422

*Primary Examiner*—Larry I. Schwartz

*Assistant Examiner*—David W. Westphal

*Attorney, Agent, or Firm*—Browdy and Neimark

[57] ABSTRACT

The invention relates to the field of bookbinding machines, and in particular to a device controlling gripper members arranged to transfer books, magazines, and the like.

The technical problem to be solved was that of providing a simple and accurate form of mesh engagement of gear wheels, constituting power drives for the movable gripper members, with stationary racks arranged in a discontinuous fashion along the path of movement of the gripper members.

The solution to the problem is provided by positioning members (15,16) projecting eccentrically from the gear wheels (4) and being adapted for engagement in an entry channel (18) located at one end of the stationary racks (14). The entry channel (18) is made gradually narrower and has an oscillating portion (20) at that portion where the positioning members tend to move as the gear wheels engage with the racks (14).

7 Claims, 6 Drawing Figures

GRIPPER MEMBER CONTROL DEVICE FOR BOOKBINDING MACHINES

BACKGROUND OF INVENTION

This invention relates to a gripper member control device for bookbinding machines, as used for transferring books, magazines, and the like.

Known heretofore in the field of bookbinding machines are apparata whereon books, magazines, brochures, and the like are formed progressively. Such apparata are arranged to perform various processing steps on a work line along which the books or the like being formed are caused to move. The book translation movement is provided by chain drives and members specially constructed for their intended functions.

One of the operations carried out on such book-binding machines or apparata is that of gripping the books or the like being formed and taking them from a substantially upright position to a position whereat they are laid onto a conveyor belt preparatory to stacking together the books in groups.

Said transfer movement is effected, on advanced design machines, by means of specially provided gripper members which adjust automatically for the book thickness, and during the transfer movement apply the required force to improve the adhesion of the cover or flap on the book.

Such gripper members, which are provided in large numbers, and driven along a closed loop path adjacent the book and the like formation line, derive their work motion from a drive which utilizes that same pulling action which moves the members in question along a closed loop path.

In practice, it is contemplated that each gripper member be translated by means of drive chains along fixed runways having fixed racks positioned therealong. Arranged to mesh with these racks is a gear wheel standing out of each gripper member and forming said drive. The gear wheel is forced to rotate about its axis by the movement of the related gripper member and on account of the fixed position of the racks, and the rotation is transmitted, for example, to a worm driving a gear made rigid with the shaft around which each gripper member is arranged to rock.

As a whole, this control device is particularly advantageous by virtue of its being simple, accurate in operation, and implying no arrangements of specific drive elements at the gripper members.

However, this control device implies the solution of the problem of how to cause each drive or gear wheel to correctly mesh with a fixed rack as the gear wheel first contacts the rack. It should be considered, in fact, that each gear wheel is driven at a relatively high speed along with its corresponding gripper member, and that during these movements, small angular oscillations take place naturally which make the angular position of each gear wheel at the time of meshing with a fixed rack a practically random one. And it may be appreciated that where the gear wheel position is not the correct one for meshing with the rack, there may be created at the time of engaging each gear wheel with one rack a condition of strong impact which may result in various failures and in all cases considerably shorten the life of the control device as indicated.

SUMMARY OF THE INVENTION

It is a primary object of this invention to solve the aforementioned technical problem by providing a gripper member control device for bookbinding machines, which is constructed to at all times enable correct meshing of each said moving gear wheel with a fixed rack.

It is another object of this invention to provide a control device which can accomplish the cited correct positioning even in the presence of quite wide angular amplitudes of the gear wheels relatively to the correct mesh position.

A further important object of this invention is to provide a device wherein the accomplishment of said correct meshing of the moving gear wheels with the racks involves no specially precise construction of the members provided to control said meshing.

A not unimportant object of this invention is to provide a device which is of simple construction and can be readily applied at a low cost to existing bookbinding machines of the general type mentioned above.

These and other objects, such as will be apparent hereinafter, are achieved by the gripper member control device for bookbinding machines, according to this invention, which comprises a drive defined by a rotary gear wheel standing out of each said gripper members being movable by dragging them along fixed runways, and a plurality of fixed racks extending parallel to said fixed runways and being adapted for engagement by said gear wheel of each gripper member, and is characterized in that it comprises positioning members for said gear wheel including an arm projecting integrally from said gear wheel, a guide pin carried on said arm, and a plurality of shaped detents adapted to define at least one entry channel for said guide pin at one end of one of said fixed racks, said entry channel gradually narrowing down to the diameter dimension of said pin and being arranged relatively to said rack to provide a constrained position of mesh engagement of said gear wheel with said rack.

BRIEF DESCRIPTION OF THE DRAWINGS

Further features and advantages of the invention will be more readily understood from the following description of a preferred embodiment thereof, with reference to the accompanying illustrative drawings, where.

DESCRIPTION OF THE PREFERRED EMBODIMENTS

Figure 1:
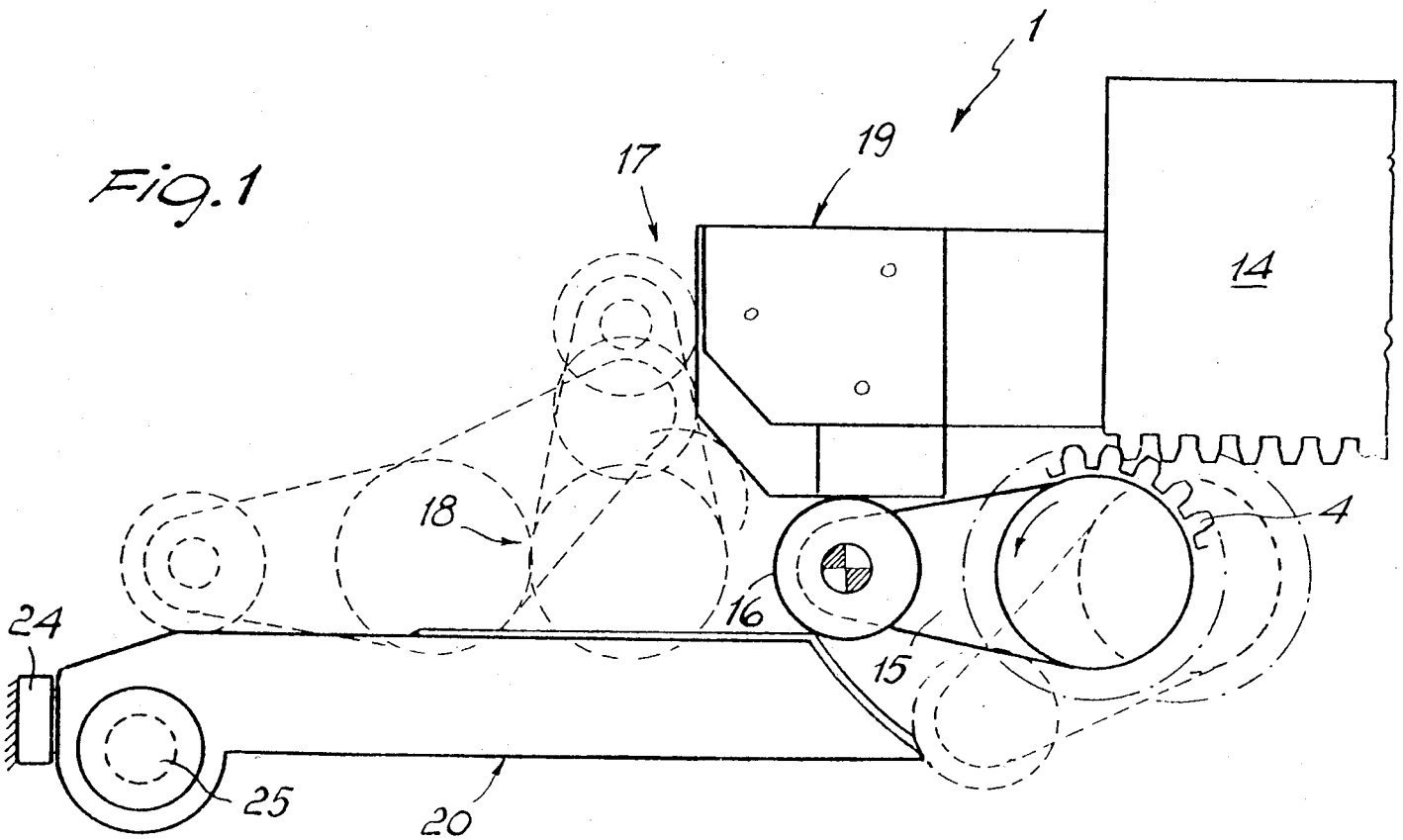
FIG. 1 is a front view of the control device of this invention at the time when a gear wheel engages with a fixed rack, the various positions which the device may take being shown in dash lines.

Making reference to the drawing views, the control device forming the subject of this application is generally designated with the reference numeral 1 in FIG. 1. The device is provided to control gripper members 2, known per se, which are shown diagramatically in FIG. 2. Said gripper members 2 comprise, briefly, a housing 3, from opposed sides whereof there project a drive or gear wheel 4 and pair of jaws 5 and 6. The first jaw 5 is allowed to oscillate angularly about a supporting shaft 7, and the second jaw 6 is slidable on the first, for example, to clamp on an oncoming book 8 resting against a lateral side 9. The jaws 5 and 6 are operative to take the book 8 onto a substantially flat conveyor 10, also as shown in dash lines in FIG. 2. Again in a known fashion, the supporting shaft 7 is made rigid with a gear 11, which engages, in turn, for example, with a worm 12 attached coaxially to the drive or gear wheel 4.

Figure 2:
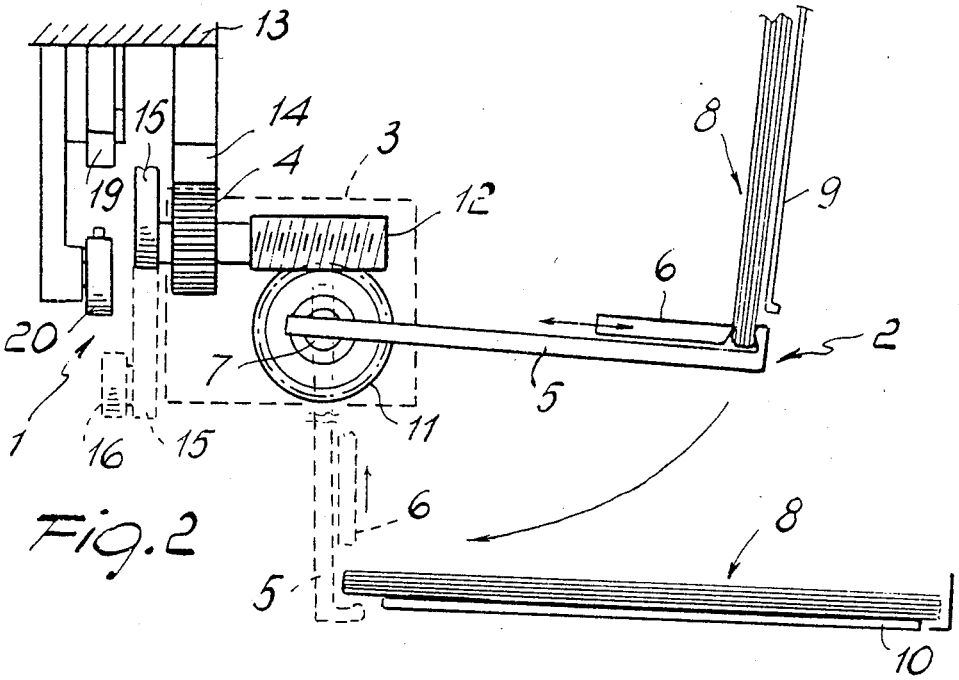
FIG. 2 is a view, taken in an orthogonal plane to the previous one, of the control device of this invention, shown associated with a gripper member which is merely outlined and occupies either of two discrete work positions one of which is shown in dash lines.
Figure 3:
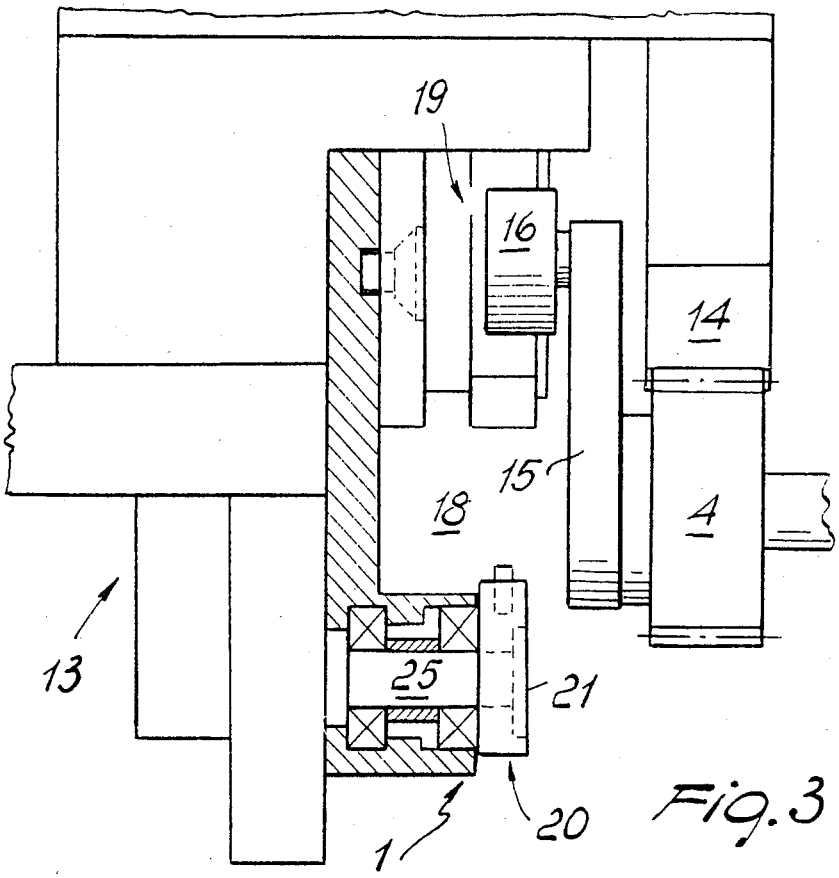
FIG. 3 shows on an enlarged scale and at an isolated position the control device of this invention as represented in FIG. 2.

Each gripper member is included to a bookbinding machine which provides the motion for the member by entraining it with drive chains, not shown. Each gripper member 2 is dragged along fixed runways located at one lateral side 13 of the machine. Along that same lateral side 13 there are racks 14 which are also fixed and parallel to the cited fixed runways. As shown in FIG. 2, the fixed racks 14 are positioned substantially tangentially to the gear wheels 4 so as to mesh therewith.

The device 1 according to the invention is particularly intended to provide correct meshing of the gear wheels 4 with the fixed racks 14. The device, in fact, includes positioning members for each gear wheel 4 which are defined by an arm 15 projecting integrally from each gear wheel 4, a guide pin 16 carried on the arm 15, and shaped detents 17 forming an entry channel 18 for the guide pin 16.

The arm 15 and guide pin 16, the latter being in the form of a small wheel cantilevered on the arm, jointly form a crank level which may be translated and turned together with its related gear wheel 4. The shaped detents 17 are formed from a fixed plate 19 defining a first side 19*a* of the entry channel 18, and from an oscillating plate 20 which defines the second side 20*a* of said entry channel 18. Said plates are positioned adjacent each end of the fixed racks 14, and the first side 19*a* of the entry channel 18 is the one from which the guide pin 16 will tend to move away as the gear wheel 18 meshes with a rack.

The entry channel 18 is generally configured to grow gradually narrower, down to the diameter dimension of the pin 16, and this by virtue of a downward abutment surface being defined by the fixed plate 19 and of a substantially horizontal contact surface being defined by the oscillating plate 20.

Figure 4:
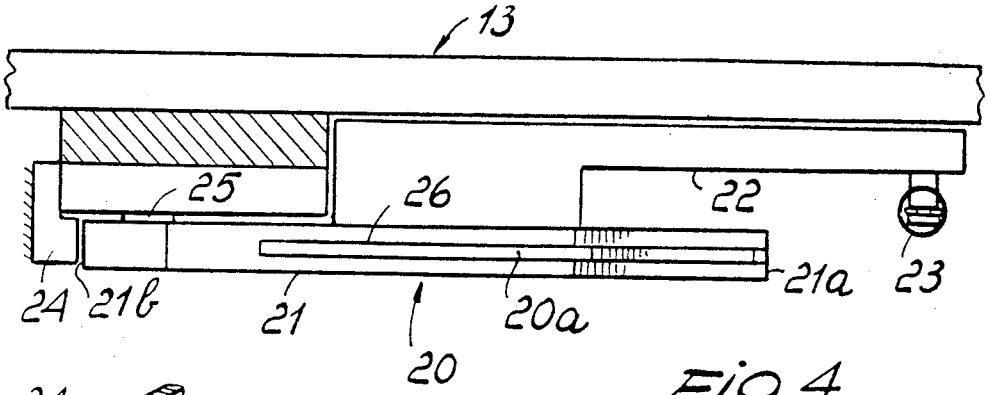
FIGS. 4 and 5 are a plan view and perspective view, respectively, of one element of the device shown in the preceding figures.
Figure 5:
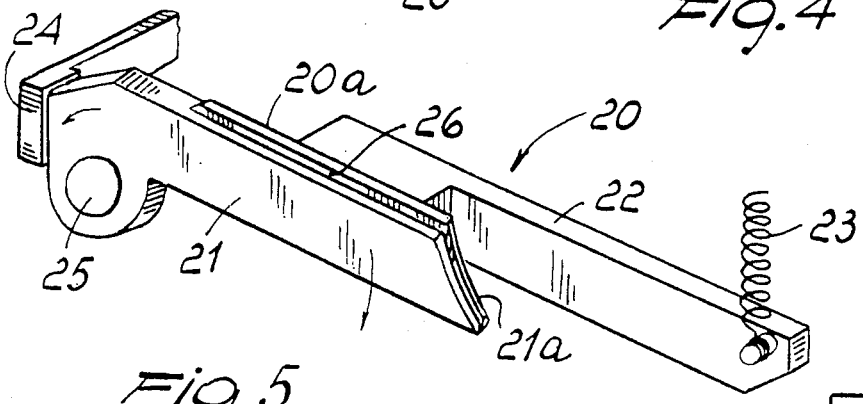

The construction of the oscillating plate 20 is shown detailedly in FIGS. 4 and 5. It may be seen that said plate is defined by a first element 21 having said contact surface 20*a* and by a second element 22 rigidly attached to one side of the first and engaged at one end by elastic means in the form of a tension spring 23.

In detail, the first element 21 extends from a first end 21*a* in the shape of an arc of a circle substantially tangent to the path followed by the guide pin 16 as the gear wheel 4 correlated thereto meshes with a fixed rack 14, to a second end 21*b* which abuts on a fixed element 24 made rigid with the lateral side 13. Passed pivotally through the first element 21, between the first end 21*a* and second end 21*b*, is a pivot pin 25 defining the oscillation axis for the entire oscillating plate 20. As shown in the drawing views, the pin 25 is brought close beside the second end 21*b* and located below the fixed element 24. In connection with the first element 21 of the oscillating plate 20, it is further to be noted that the contact surface 20*a* and end 21*a* shaped as an arc of a circle are mainly defined by a foil insert 26 of a special material.

The second element 22 is laid side-by-side but away from the first element 21, and extends away from the pin 25 to an end whereat said tension spring 23 is located. The first element 21 and second element 22 behave as a single downward rocking piece adapted to be positioned substantially horizontal by abutment on the fixed element 24.

The fixed plate 19 is formed by a set of blocks and may also have the abutment surface with a guide pin 16 defined by an insert 27.

The operation of the inventive device may be appreciated from the foregoing mainly constructional description.

As shown particularly in FIG. 1, each gear wheel 4 reaches a point close to a fixed rack 14 in a random angular position which, in turn, results in a random angular position of the arm 15 and guide pin 16. Shown in dash lines are some possible extreme positions for the guide pins 16.

Figure 6:
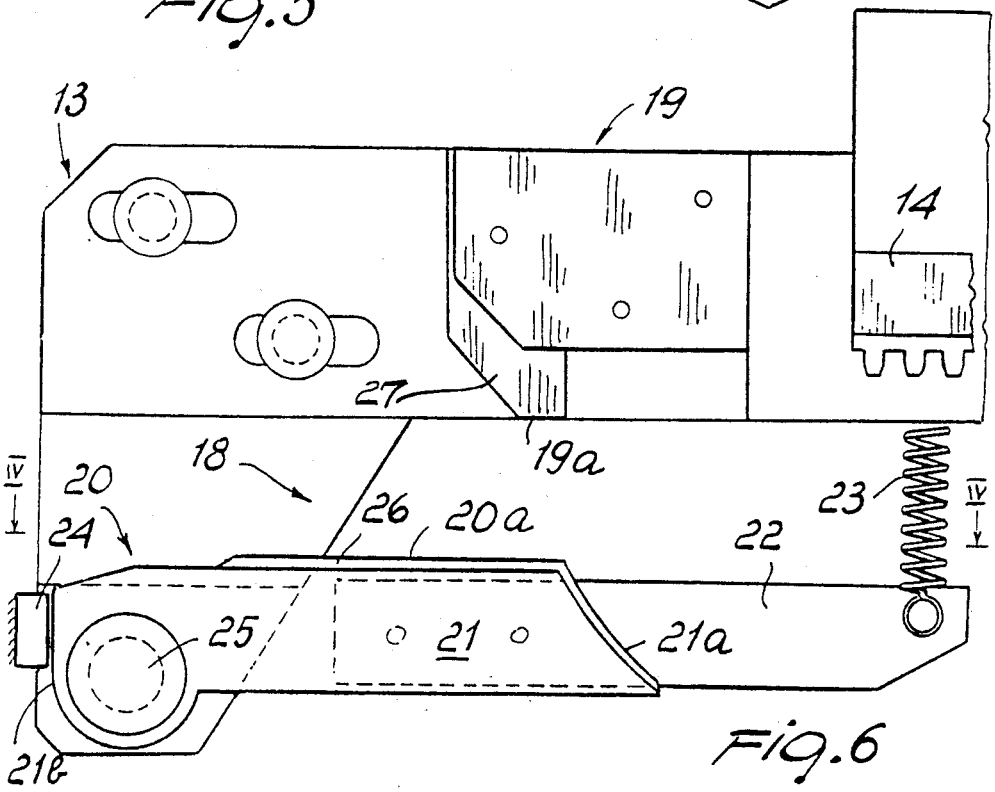
FIG. 6 is a front view of the same element as shown in FIGS. 4 and 5 in the assembled position, also illustrating members directly adjacent it.

As each gear wheel 15 approaches a fixed rack 14, the related guide pin 16 enters the entry channel 18 contacting alternately the first side 19*a* and second side 20*a* of the channel. The latter is made convergent substantially to the diameter dimension of the guide pin 16, and accordingly, it will be gradually forced to assume the position shown in full lines in FIG. 1. This position is arranged to provide a true initial mesh engagement of the gear wheel 4 with the fixed rack 14. Upon the wheel 4 engaging the rack 14, the wheel is caused to rotate owing to its translation movement together with the related gripper member 2. Rotation takes place in a counterclockwise direction as shown in FIG. 1, and moves the guide pin 16 away from the entry channel 18 on the side of the oscillating plate 20. The latter is terminated, with the first end 21*a* in the shape of an arc of a circle, in such a shape as not to interfere with the motion of the guide pin 16. In any case, a possible interference between the guide pin 16 and oscillating plate 20 would be accommodated by the tension spring 23 (FIG. 6), which after performing one oscillation, will return the plate to the horizontal position of abutment on the fixed element 24.

Thus, the invention achieves its objects.

In particular, the simplicity and functionality of the device should be enhanced, given that the same is able to correctly position gear wheels which may be in markedly incorrect positions prior to meshing with a fixed rack 14.

This result has been achieved with members which require no high precision positioning or shaping to close tolerances, thanks to some of the shaped detents which define the entry channel for the guide pin 16 being oscillatingly mounted.

All of the details may be replaced with technically equivalent elements.

In practicing the invention, the materials used, and the shapes and dimensions, may be any ones contingent on individual requirements.

I claim:

1. A gripper member (2) control device (1) for bookbinding machines, comprising a drive (4) having a rotary gear wheel standing out of each said gripper members (2) and being movable along fixed racks (14) adapted for engagement by said gear wheel (4) of each gripper member (2), positioning members for said gear wheel (4) including an arm (15) projecting integrally from said gear wheel (4), a guide pin (16) carried on said arm (15), and a plurality of shaped detents (17) adapted to define at least one entry channel (18) for said guide pin (16) at one end of one of said fixed racks (14), said arm (15) and said guide pin (16) defining jointly a crank lever and said entry channel (18) gradually narrowing down to a diameter dimension of said guide pin (16) and being arranged relatively to said rack (14) to provide a constrained position of mesh engagement of said gear wheel (4) with said rack (14).

2. A device according to claim 1, wherein said detents (17) comprise at least one fixed plate (19) defining a first side (19*a*) of said entry channel (18) on a side thereof whence said guide pin (16) tends to move away as said gear wheel (4) engages with one of said racks (14), and at least one oscillating plate (20) movable away from said fixed plate (19) and defining a second side (20*a*) of said entry channel (18) lying opposite said first side.

3. A device according to claim 2, further comprising a biasing elasting means (23) for said oscillating plate (20), said oscillating plate (20) having a first end (21*a*) shaped as an arc of a circle substantially tangent to a path followed by said guide pin (16) as said gear wheel (4) engages with one of said racks (14), and a second end (21*b*) opposite said first end (21*a*) and engaging with a pin (25) defining an axis of oscillation extending parallel to an axis of rotation of said gear wheel (4).

4. A device according to claim 3, wherein said oscillating plate (20) is defined by a first element (21) extending between said ends (21*a*, 21*b*) and being adapted to contact with said guide pin (16), and by a second element (22) attached to one side of said first element (21) and being engaged with a tension spring (23), said first element (21) having at said second end (21*b*) a surface abutting a fixed element (24).

5. A device according to claim 3, wherein a surface (20) contacting said guide pin (16) extends between said ends (21*a*, 21*b*) over said oscillating plate (20), said surface (20) having a substantially straight configuration and being substantially parallel to said one of said racks (14).

6. A device according to claim 5, wherein said fixed plate (19) defines a surface abutting said guide pin (16) and having a substantially tapering configuration toward said oscillating plate (20).

7. A device according to claim 1, wherein said guide pin (16) is defined by a small wheel cantilevered from said arm (15) and being arranged parallel to said gear wheel (4).

* * * * *

UNITED STATES PATENT AND TRADEMARK OFFICE

CERTIFICATE OF CORRECTION

PATENT NO. : 4,596,161

DATED : June 24, 1986

INVENTOR(S) : Giovanni VIGANO'

It is certified that error appears in the above-identified patent and that said Letters Patent is hereby corrected as shown below:

[73] Assignee: Correct the address of assignee to read:

--Ciserano-Zingonia (BG), Italy--

Signed and Sealed this

Sixteenth Day of December, 1986

*Attest:*

DONALD J. QUIGG

*Attesting Officer* *Commissioner of Patents and Trademarks*